US009475063B2

(12) United States Patent
Molteni

(10) Patent No.: US 9,475,063 B2
(45) Date of Patent: Oct. 25, 2016

(54) ELECTROMAGNETIC DRUM FOR CLEANING FERROMAGNETIC SCRAP OF MEDIUM AND LARGE SIZE

(71) Applicant: SGM Gantry S.p.A., Manerbio BS (IT)

(72) Inventor: Danilo Molteni, Manerbio BS (IT)

(73) Assignee: SGM GANTRY S.P.A., Manerbio (BS) (IT)

( * ) Notice: Subject to any disclaimer, the term of this patent is extended or adjusted under 35 U.S.C. 154(b) by 0 days.

(21) Appl. No.: 14/439,853

(22) PCT Filed: Oct. 31, 2013

(86) PCT No.: PCT/IB2013/059810

§ 371 (c)(1),
(2) Date: Apr. 30, 2015

(87) PCT Pub. No.: WO2014/072892

PCT Pub. Date: May 15, 2014

(65) Prior Publication Data

US 2015/0290656 A1 Oct. 15, 2015

(30) Foreign Application Priority Data

Nov. 8, 2012 (IT) ..... MI2012A1902

(51) Int. Cl.
*B03C 1/14* (2006.01)
*B03C 1/033* (2006.01)

(52) U.S. Cl.
CPC ..... *B03C 1/14* (2013.01); *B03C 1/0335* (2013.01); *B03C 2201/20* (2013.01)

(58) Field of Classification Search
CPC ..... B03C 1/0335; B03C 1/14; B03C 1/247; B03C 2201/20
See application file for complete search history.

(56) References Cited

U.S. PATENT DOCUMENTS 500,606 A * 7/1893 Payne ..... B03C 1/14 209/223.2
1,324,529 A * 12/1919 Ullrich ..... B03C 1/14 209/223.2

(Continued)

FOREIGN PATENT DOCUMENTS

DE 622785 C 12/1935
DE 885685 8/1953
DE 2007529 A1 9/1971

OTHER PUBLICATIONS

International Search Report dated Mar. 25, 2014 for PCT/IB2013/059810.

*Primary Examiner* — Joseph C Rodriguez
(74) *Attorney, Agent, or Firm* — Lucas & Mercanti, LLP

(57) ABSTRACT

An electromagnetic drum for magnetic separator comprises a cylindrical structure (6) of ferromagnetic material provided with a plurality of solenoids (2*a*, 2*b*) wound on pole bodies (1*a*, 1*b*) having pole shoes (3*a*, 4*a*; 3*b*, 4*b*) arranged at the radially distal end thereof, said pole bodies (1*a*, 1*b*) and the solenoids (2*a*, 2*b*) wound thereon being all arranged on a same side of a longitudinal midplane of the drum, the solenoids (2*a*, 2*b*) having their axes substantially perpendicular to the longitudinal drum axis and each pole body (1*a*, 1*b*) extending mainly in a plane substantially perpendicular to said drum axis and substantially parallel to the planes of the other pole bodies (1*a*, 1*b*). Such a drum can provide a magnetic field suitable to draw even very large and heavy ferromagnetic scrap without having to face polarity changes along the circumferential path and while retaining cost and size similar to conventional drums.

25 Claims, 6 Drawing Sheets

(56) References Cited

U.S. PATENT DOCUMENTS

| | | | | | |
|---|---|---|---|---|---|
| 1,380,871 | A | | 6/1921 | Swart et al. | |
| 1,527,810 | A | * | 2/1925 | Manegold | B03C 1/12 209/219 |
| 1,714,171 | A | * | 5/1929 | Jobke | B03C 1/14 209/223.2 |
| 2,750,035 | A | * | 6/1956 | Buus | B03C 1/12 209/219 |
| 2,950,008 | A | | 8/1960 | Buus et al. | |
| 3,365,599 | A | | 1/1968 | Brzezinski et al. | |
| 3,394,807 | A | * | 7/1968 | Fritz | B03C 1/14 209/219 |
| 3,426,897 | A | * | 2/1969 | Salmi | B03C 1/14 209/223.1 |
| 3,552,564 | A | * | 1/1971 | Burgener | B03C 1/23 209/214 |
| 3,552,565 | A | * | 1/1971 | Fritz | B03C 1/14 209/219 |
| 7,918,345 | B2 | * | 4/2011 | Molteni | B03C 1/14 209/215 |
| 8,196,751 | B2 | * | 6/2012 | Shuttleworth | B03C 1/12 209/214 |
| 8,561,807 | B2 | * | 10/2013 | Ross | B03C 1/14 209/212 |
| 2009/0159511 | A1 | | 6/2009 | Molteni | |
| 2011/0163015 | A1 | | 7/2011 | Shuttleworth et al. | |
| 2014/0246359 | A1 | * | 9/2014 | Jiang | B03C 1/145 209/213 |
| 2015/0291397 | A1 | * | 10/2015 | Molteni | B66C 1/06 294/65.5 |

* cited by examiner

PRIOR ART

PRIOR ART

ELECTROMAGNETIC DRUM FOR CLEANING FERROMAGNETIC SCRAP OF MEDIUM AND LARGE SIZE

CROSS-REFERENCE TO RELATED APPLICATIONS

This application is a 371 of PCT/IB2013/059810, filed Oct. 31, 2013 which, in turn, claimed the priority of Italian Patent Application No. MI2012A001902 filed on Nov. 8, 2012, both applications are incorporated herein by reference.

FIELD OF THE INVENTION

The present invention relates to magnetic separators, and in particular to an electromagnetic drum for cleaning the ferromagnetic scrap of medium and large size used in steel mills.

BACKGROUND OF THE INVENTION

It is known that the scrap of different origin normally used in steel mills contains between about 3 and 12% of non-ferromagnetic material that is mostly made up of stony material, sand, rubber, plastic and various metals such as copper, aluminium, bronze, brass, zinc, etc. which are highly detrimental to the quality of the steel that is meant to be produced from said scrap. These pollutants cause a significant increase in power consumption, in quicklime consumption and in the production of waste, which results in a lower quality and a higher cost of the steel thus produced.

It is presently difficult to meet the requirements of European Union rules that define the criteria according to which some types of metallic scrap are no longer considered waste because the scrap being used can be small or large in size, light or heavy, homogeneous or not homogeneous and therefore a single magnetic separator is not able to effectively operate on different types of scrap.

In particular, it is difficult to clean the larger and heavier scrap usually referred to as HMS 1 or HMS 2 (acronym of the expression Heavy Metal Scrap) which consists of material from shearing, rail or naval recovery, deep drawn sheets, pieces of billets, blooms and beams, etc. This type of scrap can reach a very large size and weight in the order of several quintals or even a ton.

Known electromagnetic drums used to clean ferromagnetic scrap are normally made with two or three longitudinal polarities, i.e. extending mainly in a plane parallel to the longitudinal drum axis, that are perpendicular with respect to the feed flow of the mixed ferromagnetic material from which the inert material must be removed. A typical example of a prior art two-pole drum is disclosed in US 2009/0159511 and illustrated in FIGS. 5 and 6, that show a first solenoid 21 wound around a first pole body provided with a relevant pole shoe 22 to form a first polarity, which generates a magnetomotive force equal to about ⅔ of the total magnetomotive force of the drum. As a consequence, the remaining ⅓ is generated by the second polarity formed by a second solenoid 23 wound on a second body with a relevant shoe 24, whereas in the case of three-pole drums (e.g. DE 2007529A1, FIGS. 2 and 3) the division is about 50% of the total for the first polarity, 30-35% for the second one and 15-20% for the third one.

Both two-pole and three-pole drums are also provided with a further inactive pole body 25, of reduced section and without any solenoid wound thereon, which is arranged beyond the active polarities (in the direction of rotation of the drum) and only has the function of cancelling the magnetic field to facilitate the release of the lighter ferromagnetic material. The operational arc of the magnetic field CM generated by the drum is usually of about 180° in the circumferential direction, with the axis of attraction a-a corresponding to the axis of greater magnetomotive force that is perpendicular to the axis of rotation and arranged at an angle $\alpha$ varying between 15° and 45°, depending on the design parameters, with respect to the vertical axis Y-Y in quadrant III of a Cartesian reference system XY (in the illustrated example of clockwise rotation centered in the origin).

In this case the material release zone is located in quadrant I at the cancelling pole body 25, and during the path of about 180° in the circumferential direction from the attraction zone to the release zone the attracted ferromagnetic material 26 must pass through two or three successive polarities of opposite sign. The change of polarity opposes the advancing of the ferromagnetic material 26, as readily understood also because the change of polarity is from a stronger polarity to a weaker polarity; moreover also gravity opposes the advancing that takes place upwards.

The sum of these effects that oppose the advancing results in this type of electromagnetic drums being suitable only for homogeneous and small- or medium-sized ferromagnetic scrap, such as shredded vehicles (so-called "proler"), in which the inert material to be eliminated is essentially made up of rubber, plastic and non-magnetic metals with a similar size and most of the inert material 27 is removed by free fall in the attraction zone.

The remaining part of the inert material 27, generally lighter and trapped by the ferromagnetic material 26, is released during the change of polarity when the ferromagnetic material 26 tends to roll, this being possible because in this phase the advancing of material 26 is due to a mechanical driving carried out by longitudinal ribs 28 applied on the rotating shell 29 of the drum. These ribs 28 must simultaneously raise material 26 against gravity and overcome the opposing magnetic action at the polarity change, yet they cannot be too high otherwise they would hinder the fall of the inert material and would end up dragging along too much of it thus making the cleaning action ineffective.

From the above it is readily evident that this type of electromagnetic drum is not suitable to clean medium- or large-sized ferromagnetic scrap, since it has at least two kinds of drawbacks. A first drawback stems from the fact that the scrap having such a size would easily climb over ribs 28 during the polarity change, piling up in the attraction zone until seizure of shell 29. Furthermore, even in the presence of much higher ribs 28, in the above-mentioned polarity change phase the drum would require an enormous driving torque to turn over pieces weighing even some quintals that must overcome the attraction of the stronger polarity and be drawn upwards.

Another type of known electromagnetic drum, illustrated in FIGS. 7 and 8, provides on the contrary for radial pole shoes extending perpendicularly with respect to the longitudinal drum axis and therefore parallel to the feed flow of the material to be treated. In this case, radial pole shoes 31 are arranged perpendicularly to the longitudinal drum axis and circular solenoids 32 are interposed between the radial pole shoes 31 and wound on radial pole bodies 33 that coaxially enclose the drum shaft and are integrated therewith.

Still another type of known electromagnetic drum is shown in U.S. Pat. No. 2,950,008 which discloses a drum with two solenoids wound on respective pole bodies provided with pole shoes arranged at the distal ends thereof, each solenoid having a solenoid axis perpendicular to a central longitudinal axis of the drum and each pole body extending in a plane perpendicular to the drum axis.

These pole bodies are located at intermediate positions between a central pole body and two end pole bodies that have neither solenoids wound thereon nor pole shoes arranged at the distal ends thereof, said unwound pole bodies constituting regions of great magnetic dispersion. The resulting magnetic field is quite wavy in the longitudinal direction with values at the central unwound pole which are about half the values at the adjacent wound poles.

Furthermore in the drum disclosed in this document the poles are mounted on a plate that is offset from the center of the drum at a position beyond the drum axis thus resulting in a longer ferromagnetic circuit with higher dispersion. This position of the support plate is made necessary by the fact of having only two wound poles whereby in order to obtain a higher magnetic field the two solenoids must be higher, i.e. have more turns, and thus must extend beyond the drum midplane.

These other two types of drums are normally employed for an opposite function with respect to the above-described drums, namely to clean inert materials polluted by ferromagnetic material that represents a small fraction of the material to be treated.

Although in these types of drum the ferromagnetic material does not have to pass through successive polarities of opposite sign in its circumferential path around the drum, and therefore the required torque would not be too high, nonetheless they are not suitable to clean medium- or large-sized ferromagnetic scrap due to at least two kinds of drawbacks. In the first place these types of drum would require a significant oversizing of the parts to be used for this function, since they are designed to remove small amounts of ferromagnetic material, and therefore would result expensive and bulky.

Secondly, their constructive shape is magnetically dispersive and poorly effective in performing the required function in the active zone, namely on the surface of the rotating shell. In particular, in the prior art drum illustrated in FIGS. 7, 8, given the great distance between solenoids 32 and the active zone of the rotating shell 34 the dispersion of the magnetic field with such a structure can be estimated at 50-60% (it should be noted that the axis of attraction corresponding to the axis of the greatest magnetomotive force in this case coincides with the axis of rotation r-r of shell 34).

In other words, with such prior art drums the magnetic field and the magnetic field gradient are insufficient both to attract the ferromagnetic material from a distance suitable to determine an adequate fall zone for the inert material, and to draw ferromagnetic pieces weighing hundreds of kilograms and/or having a large size.

SUMMARY OF THE INVENTION

Therefore the object of the present invention is to provide an electromagnetic drum which overcomes the above-mentioned drawbacks. This object is achieved by means of a drum in which central, intermediate and end pole bodies all have solenoids wound thereon and pole shoes arranged at the distal ends thereof, said pole bodies being all arranged on a same side of a longitudinal midplane of the drum, the solenoids having their axes substantially perpendicular to the longitudinal drum axis and each pole body extending mainly in a plane substantially perpendicular to said drum axis and substantially parallel to the planes of the other pole bodies, such that also the axis of attraction is perpendicular to said drum axis and there is no polarity change in the circumferential direction. Other advantageous features are disclosed in the dependent claims.

The main advantage of the drum according to the present invention is therefore that of providing a magnetic field suitable to draw even very large and heavy ferromagnetic scrap with a very low dispersion of the magnetic field, without having to face polarity changes along the circumferential path and while keeping cost and size similar to those of conventional drums. In this way it is possible to effectively clean even HMS 1 and HMS 2 scrap, thus increasing the quality and decreasing the cost of the steel produced from said scrap.

These and other advantages and characteristics of the electromagnetic drum according to the present invention will be clear to those skilled in the art from the following detailed description of an embodiment thereof, with reference to the annexed drawings wherein:

BRIEF DESCRIPTION OF THE DRAWINGS

FIG. 3 is a cross-sectional view of the drum showing its geometrical parameters;

DETAILED DESCRIPTION OF THE INVENTION

Figure 1:
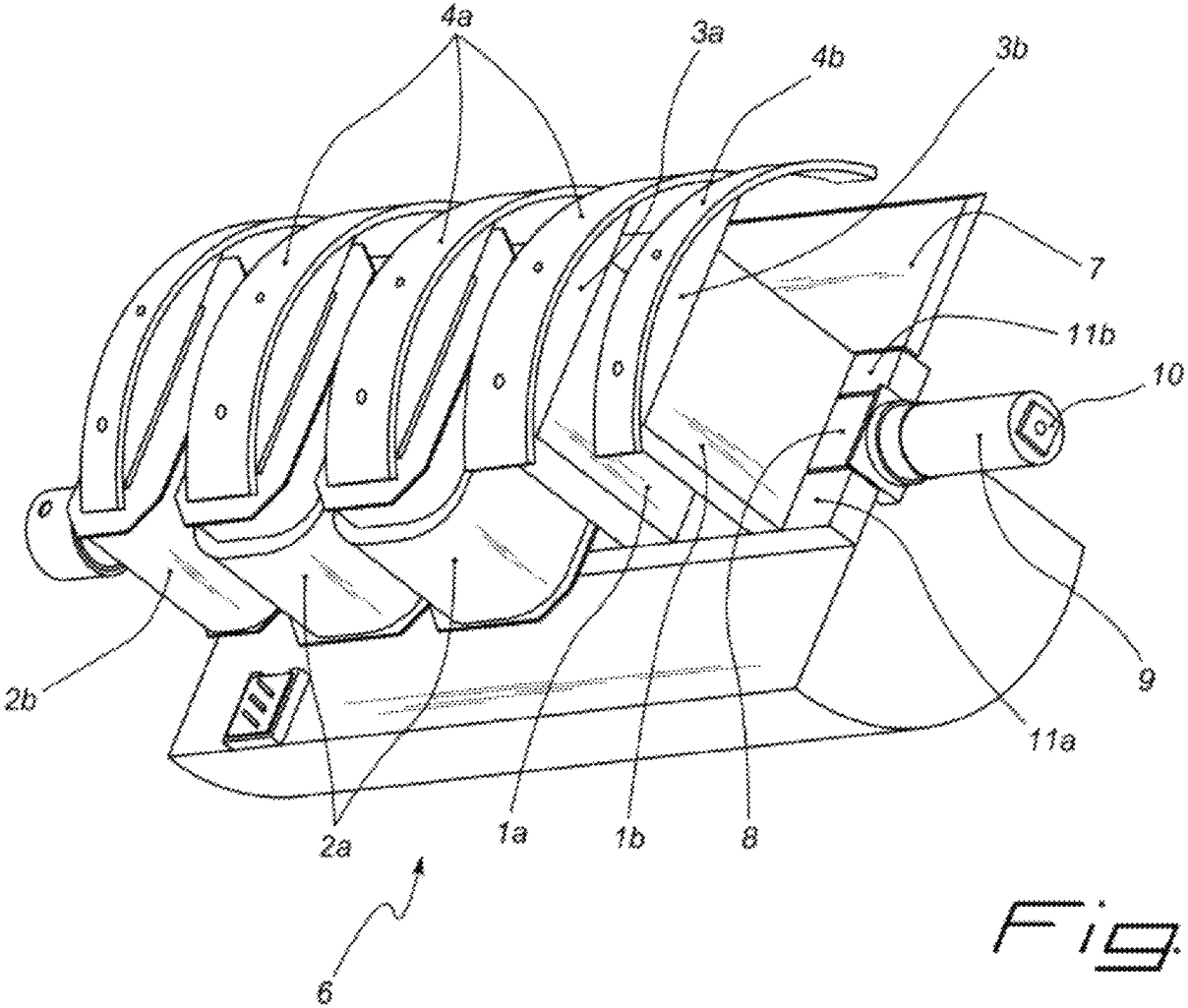
FIG. 1 is a perspective view of the internal components of the drum with two solenoids removed for the sake of clarity.
Figure 2:
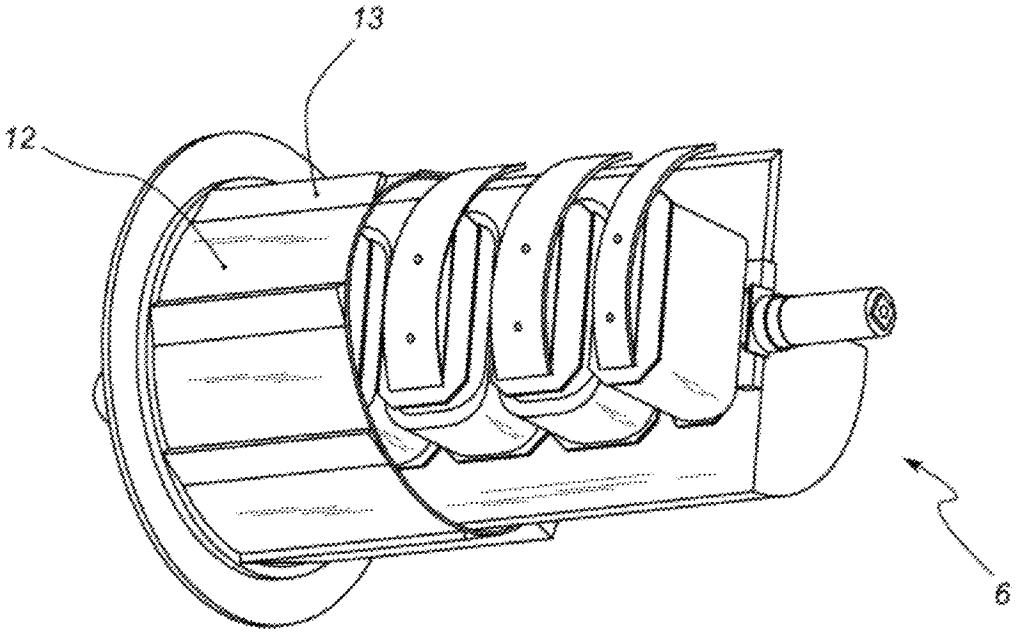
FIG. 2 is a perspective view of the drum with a portion removed.
Figure 7:
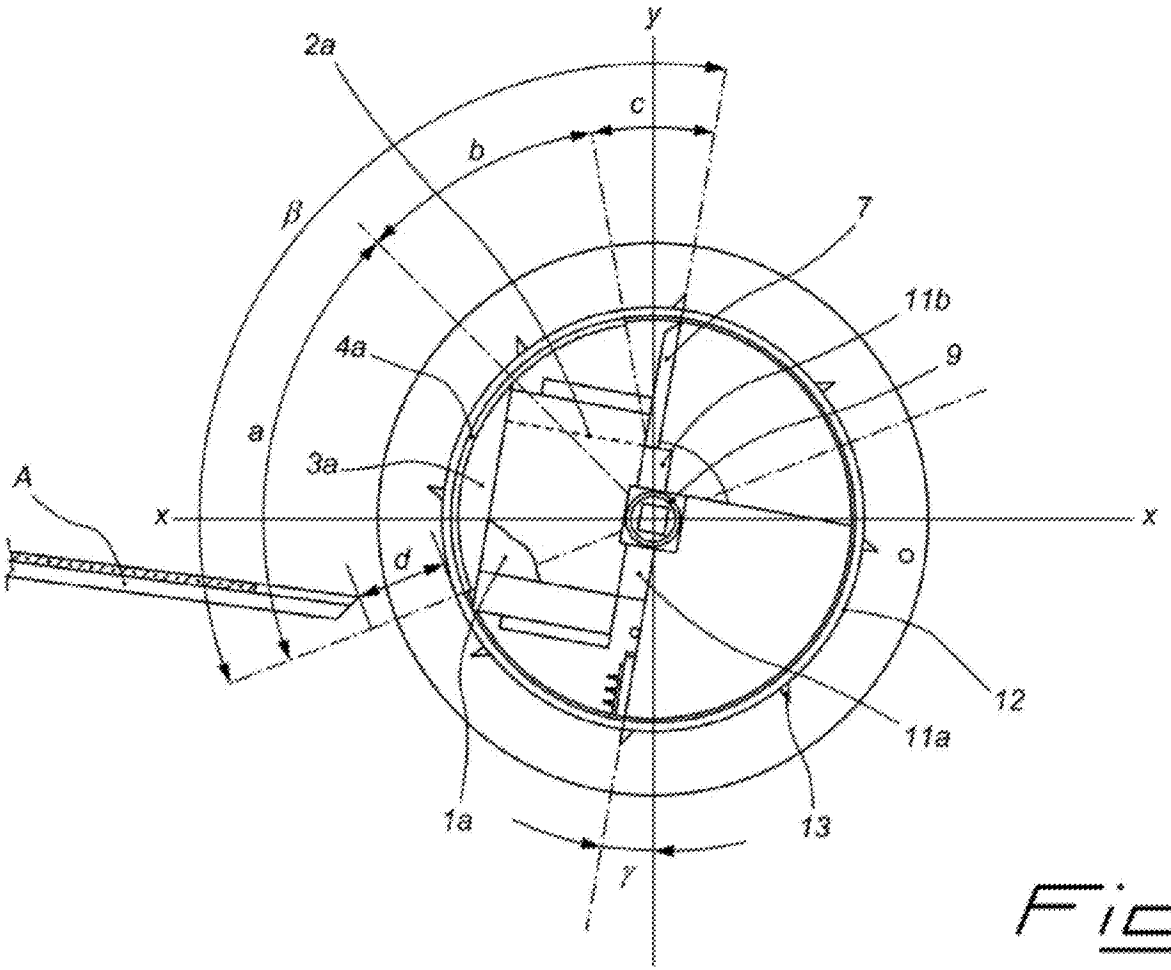
FIGS. 5-8 show two types of conventional drums as previously explained.
Figure 4:
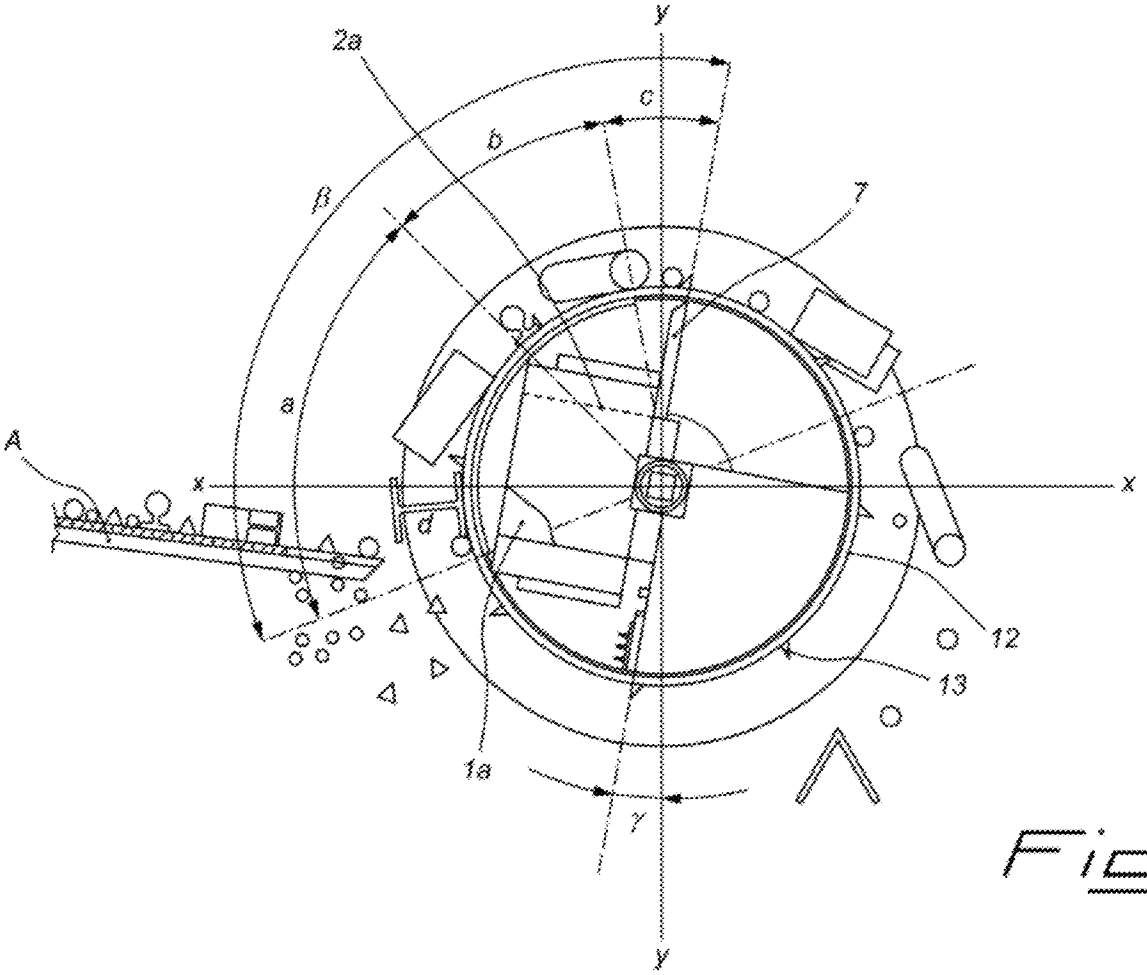
FIG. 4 is a view similar to the preceding one that shows the operation of the drum.
Figure 5:
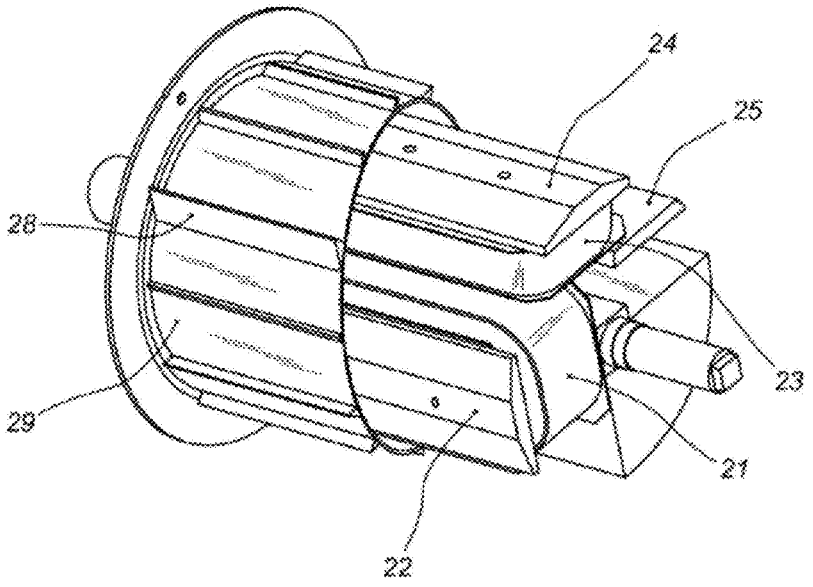
Figure 6:
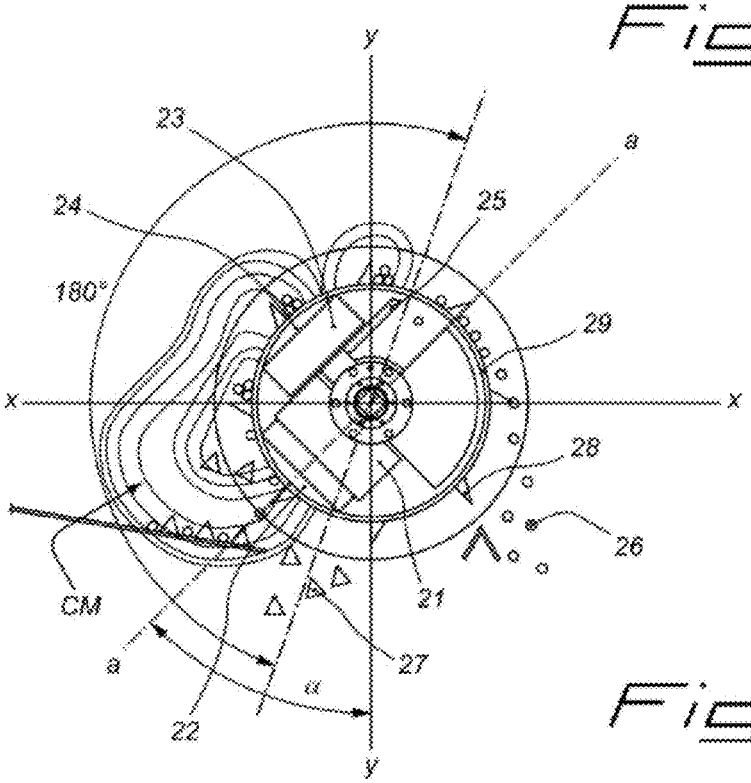
Fig.6 PRIOR ART
Figure 7:
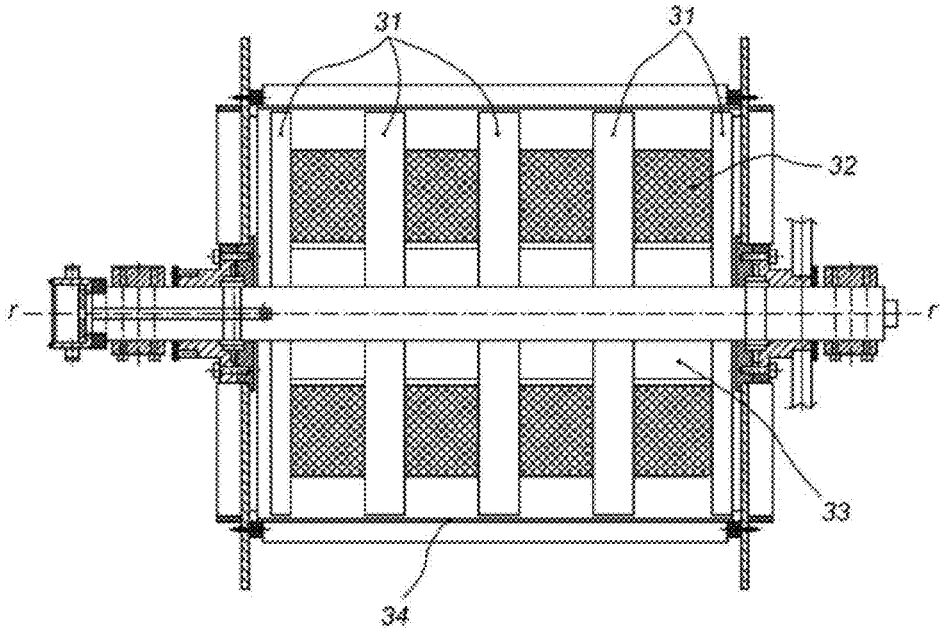
Figure 8:
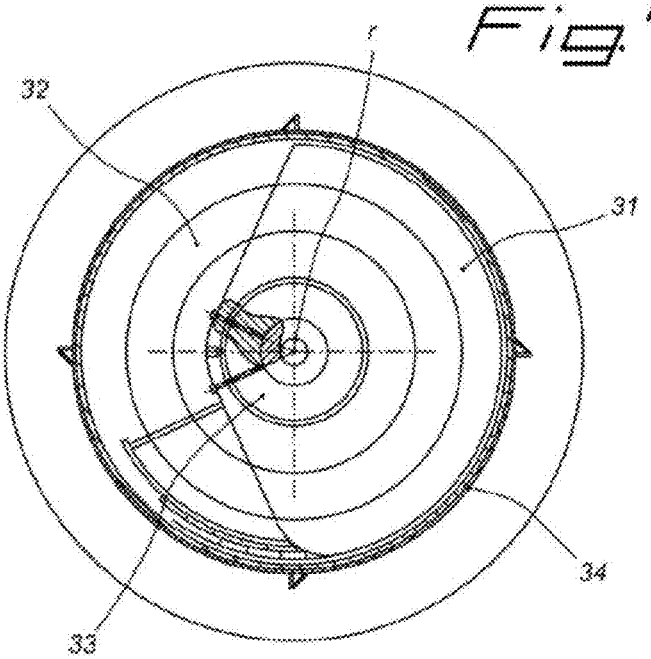
Fig. 8 PRIOR ART

With reference to FIGS. 1-4, there is seen that a drum according to the present invention conventionally includes a generally cylindrical structure 6 of ferromagnetic material provided with a plurality of pole shoes (five in the illustrated embodiment) extending mainly in planes substantially parallel to each other and perpendicular to the longitudinal axis of the drum, said structure 6 being enclosed within a shell 12 of non-magnetic material that is rotatably mounted coaxially around structure 6 and is provided with longitudinal ribs 13.

A first novel aspect of the present drum that distinguishes it from the above-described prior art drums resides in the fact that the pole bodies and the solenoids wound thereon are all arranged on a same side of a longitudinal midplane of the drum, the solenoids being wound on all pole bodies with their axes substantially perpendicular to the longitudinal drum axis and each pole body having a pole shoe arranged at the distal end thereof, the pole bodies extending in a plane substantially perpendicular to said drum axis and substantially parallel to the planes of the other pole bodies.

The central pole bodies 1*a* preferably have a larger magnetic cross-section than the end pole bodies 1*b*, which have a magnetic cross-section reduced by 40-45% with respect to the former. The expression "magnetic cross-section" is used here to indicate the cross-section of the magnetic element (pole body, pole shoe, circuit column, etc.) that is crossed substantially perpendicularly by the flux lines of the magnetic field.

Correspondingly, also solenoids 2*a* wound on the central pole bodies 1*a* are larger than solenoids 2*b* wound on the end pole bodies 1*b*, which provide a magnetomotive force smaller by 25-35% with respect to the former, and the pole shoes located on top of the central pole bodies 1*a* are larger than the pole shoes located on top of the end pole bodies 1*b*, these latter pole shoes having a magnetic cross-section reduced by 35-40% with respect to the former.

More specifically, in a second novel aspect of the invention, each pole shoe is made up of a first part 3*a*, 3*b* directly secured on the corresponding pole body 1*a*, 1*b* and of a second part 4*a*, 4*b* secured on said first part 3*a*, 3*b*. The latter is shaped like a circular segment and the second part 4*a*, 4*b* is shaped like a calendered plate having a radius of curvature corresponding to the radius of the active surface of the drum, i.e. the distance between the longitudinal axis of the drum and the radially distal surface of said second part, around which the non-magnetic shell 12 rotates with a play in the order of 10 mm.

In the preferred embodiment illustrated in the figures, the circular segments 3*a*, 3*b* extend along an arc of about 76° (FIG. 3, zone a), the curved plates 4*a*, 4*b* cover the circular segments 3*a*, 3*b* and extend beyond them by about 34° in the direction of rotation of shell 12 (FIG. 3, zone b), and finally a conventional cancelling pole body 7 is located about 15° beyond the tails of the pole shoes (FIG. 3, zone c). The overall operational arc β is therefore of about 125°±5°, divided into 70°-80° of zone a of maximum activity in which each pole shoe has a magnetic cross-section preferably about twice the magnetic cross-section of the corresponding pole body, 30°-40° of zone b of progressive reduction of the magnetic field in which each pole shoe has a magnetic cross-section preferably about the same as the corresponding pole body and 10°-20° of zone c where the magnetic field is cancelled.

The magnetic circuit column connecting the five polarities preferably includes a central square bar 8 of ferromagnetic steel at whose ends there are formed hubs 9 provided with seats for rotation bearings of shell 12 and for locking clamps for drum supports. On at least an end face of one of hubs 9 there is also preferably formed a stud 10 (e.g. square) for adjusting the position of the magnetic field with respect to the vertical axis Y-Y (see angle γ in FIG. 3).

On two opposite sides of the central square bar 8 there are secured two longerons 11*a*, 11*b* of ferromagnetic steel so as to form with said bar 8 a plane having a width not smaller than the length of the pole bodies 1*a*, 1*b*, a magnetic cross-section not smaller than the magnetic cross-section of the end pole bodies 1*b*, and a length substantially equal to the length of the cylindrical structure 6 that defines the active table of the magnetic drum (indicatively 2-3 m of length for drums 1.5-1.8 m in diameter).

It should be noted that longeron 11*a* arranged on the side of square bar 8 opposite with respect to the side where the cancelling pole body 7 is located is preferably wider than the other longeron 11*b* because the pole bodies 1*a*, 1*b* do not extend symmetrically with respect to the axis of rotation of shell 12 but project more on the side farther from the cancelling pole body 7.

The five solenoids 2*a*, 2*b* wound on the corresponding pole bodies 1*a*, 1*b* are preferably connected in series and generate a magnetomotive force (with the above-mentioned percentage ratios) that determines a magnetic field and a corresponding magnetic field gradient capable of attracting, in the operational zone, ferromagnetic scrap of any shape factor even from a great distance when it is still on the feed slope A, which preferably consists of a vibrating chute with a comb-shaped end portion.

Ribs 13 of shell 12 are similar in height to ribs 28 of prior art drums, preferably about 65 mm, and therefore do not hinder the fall of the inert material in the attraction zone since the distance d between the vibrating chute A and the drum shell 12 is preferably about 250 mm (see FIG. 3).

In the light of the description above the simple and effective operation of the electromagnetic drum according to the present invention is readily understood.

Ribs 13 are sufficient to support the advancing of small-sized ferromagnetic scrap while medium- and large-sized pieces weighing from some quintals to about a ton are attracted and kept retained on shell 12 by the magnetic field, without any polarity change, until they are drawn to the release zone beyond the operational arc β where they have already crossed the vertical axis Y-Y and fall by gravity. The resisting torque of shell 12 is discharged on bearings whose friction coefficient is obviously low, whereby the driving torque required to the motor system is not excessive.

The small-sized pieces of inert material fall through the comb-shaped portion at the end of the feed slope A, while the inert materials of larger size fall at the end of slope A thanks to the distance d from shell 12. It should be noted that the comb-shaped portion also has the function of dropping the soil mixed with rust (iron oxide) before it reaches the end of slope A where it could be attracted by the drum, whereas small-sized ferromagnetic scrap is usually attracted by the drum even from the comb-shaped portion.

Therefore it is clear that this new type of electromagnetic drum is suitable to attract and draw ferromagnetic scrap of any size and with a weight in the range from about 0.01 to 1000 kg, whereby it can effectively clean any kind of ferromagnetic scrap suitable to be loaded into a melting furnace of a steel mill.

It is clear that the above-described and illustrated embodiment of the drum according to the invention is just an example susceptible of various modifications. In particular, various parameters such as the number of polarities, the dimensional ratios between the various components, the number and size of ribs 13 as well as the extension of the operational arc β may change according to specific manufacturing needs as long as the general structure of the drum is maintained.

The invention claimed is:

1. An electromagnetic drum for magnetic separator comprising a generally cylindrical structure of ferromagnetic material provided with a plurality of solenoids wound on pole bodies having pole shoes arranged at the radially distal end thereof, each solenoid having a solenoid axis substantially perpendicular to a central longitudinal axis of the drum and each pole body extending in a plane substantially perpendicular to said drum axis and substantially parallel to the planes of the other pole bodies, said cylindrical structure being enclosed within a cylindrical shell of non-magnetic material that is rotatably mounted coaxially around the cylindrical structure and is provided with longitudinal ribs, and an unwound pole body without a solenoid wound thereon which only serves the purpose of cancelling the magnetic field being arranged beyond said solenoids in the direction of rotation of said shell in a plane substantially perpendicular to the planes of the pole bodies, wherein said electromagnetic drum includes central and end pole bodies all having solenoids wound thereon and pole shoes arranged at the radially distal ends thereof and in that said pole bodies and the solenoids wound thereon are all arranged on a same side of a longitudinal midplane of the drum.

2. The drum according to claim 1, wherein the cross-section of the central pole bodies that is crossed substantially perpendicularly by the flux lines of the magnetic field is greater than that of the end pole bodies, and the solenoids wound on the central pole bodies are larger than the solenoids wound on the end pole bodies.

3. The drum according to claim 2, wherein the cross-section of the end pole bodies that is crossed substantially perpendicularly by the flux lines of the magnetic field is reduced by 40-45% with respect to the central pole bodies.

4. The drum according to claim 2, wherein the solenoids wound on the end pole bodies are suitable to provide a magnetomotive force smaller by 25-35% with respect to the solenoids wound on the central pole bodies.

5. The drum according to claim 1, wherein the central pole bodies have pole shoes larger than the end pole bodies.

6. The drum according to claim 5, wherein the cross-section of the pole shoes of the end pole bodies that is crossed substantially perpendicularly by the flux lines of the magnetic field is reduced by 35-40% with respect to the pole shoes of the central pole bodies.

7. The drum according to claim 1, wherein each pole shoe is made up of a first part having the shape of a circular segment and directly secured on the corresponding pole body, and of a second part secured on said first part and having the shape of a calendered plate having a radius of curvature corresponding to the distance between the longitudinal axis of the drum and the radially distal surface of said second part.

8. The drum according to claim 7, wherein the circular segments extend along an arc of 70°-80°, the calendered plates cover said circular segments extending beyond them by 30°-40° in the direction of rotation of the shell and the unwound pole body for cancelling the magnetic field is located 10°-20° beyond said calendered plates.

9. The drum according to claim 1, wherein the plurality of pole bodies having solenoids wound thereon are connected through a magnetic circuit column having a width not smaller than the length of said pole bodies, said magnetic circuit column having a cross-section that is crossed substantially perpendicularly by the flux lines of the magnetic field that is not smaller than the cross-section of the end pole bodies that is crossed substantially perpendicularly by the flux lines of the magnetic field, and said magnetic circuit column having a length substantially equal to the length of the cylindrical structure.

10. The drum according to claim 9, wherein the magnetic circuit column is made up of a central square bar at whose ends there are formed hubs provided with seats for rotation bearings of the shell and for locking clamps for drum supports, and of two lateral longerons arranged on opposite sides of said central square bar.

11. The drum according to claim 10, wherein the longeron arranged on the side farther from the unwound pole body is wider than the other longeron.

12. The drum according to claim 10, wherein on at least an end face of one of the hubs there is formed a stud for adjusting the position of the magnetic field.

13. The drum according to claim 1, wherein the solenoids are connected in series.

14. A magnetic separator comprising an electromagnetic drum according to claim 1, further comprising a slope (A) for feeding the material to be treated which consists of a vibrating chute with a comb-shaped end portion that is spaced substantially 250 mm from the drum shell, the ribs of said shell being substantially 65 mm high.

15. The drum according to claim 5, wherein each pole shoe is made up of a first part having the shape of a circular segment and directly secured on the corresponding pole body, and of a second part secured on said first part and having the shape of a calendered plate having a radius of curvature corresponding to the distance between the longitudinal axis of the drum and the radially distal surface of said second part.

16. The drum according to claim 6, wherein each pole shoe is made up of a first part having the shape of a circular segment and directly secured on the corresponding pole body, and of a second part secured on said first part and having the shape of a calendered plate having a radius of curvature corresponding to the distance between the longitudinal axis of the drum and the radially distal surface of said second part.

17. The drum according to claim 15, wherein the circular segments extend along an arc of 70°-80°, the calendered plates cover said circular segments extending beyond them by 30°-40° in the direction of rotation of the shell and the unwound pole body for cancelling the magnetic field is located 10°-20° beyond said calendered plates.

18. The drum according to claim 16, wherein the circular segments extend along an arc of 70°-80°, the calendered plates cover said circular segments extending beyond them by 30°-40° in the direction of rotation of the shell and the unwound pole body for cancelling the magnetic field is located 10°-20° beyond said calendered plates.

19. The drum according to claim 5, wherein the solenoids are connected in series.

20. The drum according to claim 6, wherein the solenoids are connected in series.

21. The drum according to claim 7, wherein the solenoids are connected in series.

22. The drum according to claim 15, wherein the solenoids are connected in series.

23. The drum according to claim 16, wherein the solenoids are connected in series.

24. The drum according to claim 17, wherein the solenoids are connected in series.

25. The drum according to claim 18, wherein the solenoids are connected in series.

* * * * *